US006524128B2

(12) United States Patent
Marowsky et al.

(10) Patent No.: US 6,524,128 B2
(45) Date of Patent: Feb. 25, 2003

(54) MODULAR PLUG WIRE ALIGNER

(75) Inventors: Richard D. Marowsky, York, PA (US); Dennis Bush, Street, MD (US); Robert Colantuono, Dover, PA (US)

(73) Assignee: Stewart Connector Systems, Inc., Glen Rock, PA (US)

( * ) Notice: Subject to any disclaimer, the term of this patent is extended or adjusted under 35 U.S.C. 154(b) by 0 days.

(21) Appl. No.: 09/875,452

(22) Filed: Jun. 4, 2001

(65) Prior Publication Data

US 2002/0048990 A1 Apr. 25, 2002

Related U.S. Application Data

(60) Provisional application No. 60/208,832, filed on Jun. 2, 2000.

(51) Int. Cl.[7] ..... H01R 4/24
(52) U.S. Cl. ..... 439/418
(58) Field of Search ..... 439/418, 676, 439/941, 694, 445

(56) References Cited

U.S. PATENT DOCUMENTS

| | | | | |
|---|---|---|---|---|
| 5,885,111 A | * | 3/1999 | Yu | 439/676 |
| 6,083,052 A | * | 7/2000 | Adams et al. | 439/476 |
| 6,238,235 B1 | * | 5/2001 | Shavit et al. | 439/418 |
| 6,280,232 B1 | * | 8/2001 | Beecher et al. | 439/418 |

* cited by examiner

*Primary Examiner*—P. Austin Bradley
*Assistant Examiner*—Alexander Gilman
(74) *Attorney, Agent, or Firm*—Steinberg & Raskin, P.C.

(57) ABSTRACT

A wire aligner for assembly with the end portions of four twisted pairs of wires of a multi-conductor cable, is formed as a wire aligner housing having front and rear parts along a central longitudinal axis, the front part defining longitudinally therethrough three channels which are spaced apart horizontally as middle, left and right channels to define a first horizontal plane, and two upper channels spaced apart from each other and defining a second horizontal plane spaced from and above the first horizontal plane. The rear part extends rearwardly from the front part and comprises (a) a pair of left and right separators spaced apart horizontally to define a central space between them and left and right spaces outward of the left and right separators respectively, and (b) a divider extending horizontally between the separators and defining central upper and central lower spaces respectively. These separators are insertable between end portions of the multi-conductor cable such that end portions of two twisted pairs may become situated in each of the left and right spaces respectively, and end portions of two other of the four twisted pairs may become situated in each of the central upper and lower spaces respectively.

Each of the channels in the first horizontal plane is adapted to hold the end portions of one of the pairs wires substantially straight and parallel to each other as they extend through their respective channels, and each of the channels in the second horizontal plane is adapted to hold a single wire of the twisted pair extending through the central upper space.

18 Claims, 8 Drawing Sheets

MODULAR PLUG WIRE ALIGNER

This application is related to U.S. provisional application Serial No. 60/208,832, filed Jun. 2, 2000.

FIELD OF THE INVENTION

This invention relates generally to modular electrical plugs, and more particularly to a modular plug having performance properties which will be in compliance with Category 6 standards.

The present invention also relates to plug-cable assemblies of a multi-conductor cable with a plug at one end terminating the cable and a plug or other electrical connector terminating the other end of the cable, and to plug-cable assemblies which include a load bar operative with the end of a multi-conductor cable coupled with a plug housing.

BACKGROUND OF THE INVENTION

In view of the continual desire to increase the transmission rate of data through electrical cables, new performance standards are being promulgated for modular electrical connectors. Connectors having characteristics in compliance with this standard will be known as Category 6 connectors, or Cat 6 connectors for short.

Although existing modular connectors such as jacks and plugs, e.g., those having characteristics in compliance with the immediate lower standards (Category 5), might be found to be in compliance with Category 6 standards as well, it is advantageous to develop new modular connectors designed specifically to comply with Cat 6 standards.

Cat 6 modular jacks and plugs are intended to be used in data communication networks to enable the flow of information at higher transmission rates than currently available with known modular connectors, including Cat 3 and Cat 5 connectors. However, data transmitted at high rates in multi-pair data communication cables has an increased susceptibility to crosstalk, which often adversely affects the processing and integrity of the transmitted data. Crosstalk occurs when signal energy "crosses" from one signal pair to another. The point at which the signal crosses or couples from one set of conductors to another may be 1) within the connector or internal circuitry of the transmitting station, referred to as "near-end" crosstalk, 2) within the connector or internal circuitry of the receiving station, referred to as "far-end crosstalk", or 3) within the interconnecting cable.

Near-end crosstalk ("NEXT") is especially troublesome in the case of telecommunication connectors of the type specified in sub-part F of FCC part 68.500, commonly referred to as modular connectors. The EIA/TIA (Electronic/Telecommunication Industry Association) of ANSI has promulgated electrical specifications for near-end crosstalk isolation in network connectors to ensure that the connectors themselves do not compromise the overall performance of the unshielded twisted pair (UTP) interconnect hardware typically used in LAN systems. It is expected that electrical specifications for Cat 6 plugs will also be promulgated in the near future.

Reference is made to the prior art U.S. Pat. No. 5,628,647 (Rohrbaugh et al., incorporated by reference herein) which describes Cat 5 modular plugs including a management bar or load bar for receiving the conductors in separate conductor-receiving channels. Inter-conductor capacitance in the plugs is reduced by offsetting adjacent conductors, i.e., vertically spacing adjacent conductors from one another, such that the conductor-receiving channels, and thus the conductors, ate arranged in two planar arrays spaced one above the other. The offset conductors help to lower the plug's internal capacitance.

When certain wire types are used with current modular plug designs, inconsistencies in plug electrical performance have been found when there is a lack of control in the manner in which twisted pairs of wire conductors are loaded into the management or load bar of the plug. The amount of twists and pitch of the twisted pairs are critical elements to the consistency of the electrical performance between plugs of the same design. Wire pairs which become straightened or become intermingled with other wire pairs without a controlled configuration suffer from increased crosstalk. The current process of manually loading the wires into a load bar provides insufficient control over the amount of twists or the organization of the wires making the transition from the multi-conductor cable to the load bar.

The prior art load bar illustrated in FIG. 1 herein, includes first (or rearward), second (or intermediate) and third (or forward) longitudinally adjoining portions, the third portion being situated below the contact-receiving slots and each portion having a different transverse cross sectional form, although the load bar housing is a unitary member. At a top level two channels are formed from a longitudinal indentation or trough on an upper surface of the rearward portion, a shaped cavity or bore in the intermediate portion and a longitudinal indentation or trough on an upper surface of the third portion. A groove is provided in the first and second portions to receive a conductive strip and hold the conductive strip between the channels in the first level and thereby correct an impedance problem arising from the horizontal separation of the conductors received in the channels in this level. At a bottom level two channels are formed from a respective longitudinal indentation on a lower surface of the first portion, a shaped cavity in the second portion and a respective indentation on an upper surface of the third portion. The conductive strips may be strips of metallic material such as copper, strips of conductive plastic, strips of insert molded plastic surrounding a metal strip or an electroplated strip of plastic, i.e., plastic overlaid with metal.

This prior art load bar is a two-level 8-position component, wherein each of the channels for conductors 3 and 6 of pair #3 are defined at a first or upper level by a longitudinal indentation or trough extending on an upper surface of a first portion and extending partially into the second portion, a shaped cavity or bore extending through the remainder of the second portion and an indentation or trough extending through the remainder of the second portion and an indentation or trough extending on the upper surface of the third portion. Similar conductive strip retaining means are provided for retaining a conductive strip between the two channels in the upper level. Each of two additional channels for receiving conductors 4 and 5 of conductor pair #1 are defined at a second or bottom level by a shaped cavity or bore extending through the first and second housing portions and an aligned indentation or trough extending on the upper surface of the third portion. These channels are preferably arranged between the channels in the first level in a transverse direction of the housing. Further, two additional pairs of channels for the conductors of pairs #2 and #4 are situated in the second or bottom level. These channels are also formed by shaped cavities or bores extending through the first and second housing portions and aligned indentations or troughs extending on the upper surface of the third portion.

A terminal blade for the above-described modular plug comprises a flat conductive member having a first portion having an upper edge surface adapted to contact a contact of a mating electrical connector, a second portion adjoining the first portion and having a narrow length than the first portion and a third portion adjoining the second portion and having insulation-piercing tines. A notch is defined in the upper surface to partition the upper surface into two sections, each defining a side of the notch.

OBJECTS AND SUMMARY OF THE INVENTION

It is an object of the present invention to provide new and improved modular plugs and modular plug-cable assemblies including the same.

It is another object of the present invention to provide new and improved modular plugs and modular plug-cable assemblies including such new modular plugs in compliance with Category 6 standards.

It is still another object of the present invention to provide a new device, called a wire aligner herein, for use with a load bar in a modular plug-cable assembly which will control the amount of twist of the wires pairs making the transition from the cable to the load bar.

Another object of the present invention to provide a wire aligner for use with a load bar in a modular plug-cable assembly which will control the organization of the wire pairs making the transition from the cable to the load bar.

Yet another object of the present invention to provide a new wire aligner for use with a load bar in a modular plug-cable assembly which will control the amount of crosstalk in the wires pairs due to straightness or intermingling of the wires.

It is another object of the present invention to provide a new and improved conductor management bar or load bar for coordination with the new wire aligner.

It is a further object of the present invention to provide a new modular plug which combines the new wire aligner, the new load bar and a conventional plug housing.

The present invention includes (a) a new wire aligner, (b) a new wire aligner and multi-conductor subassembly, (c) a new wire aligner and a load bar subassembly, (d) a new wire aligner, load bar and plug housing subassembly which may further include a multi-conductor cable, and (e) a method of assembling a multi-conductor cable and a load bar to achieve substantially the same amount of untwist in each of said twisted wire pairs.

In one preferred embodiment, for example, a wire aligner for assembly with the end portions of four twisted pairs of wires of a multi-conductor comprises: a wire aligner housing having front and rear parts along a central longitudinal axis, said front part defining longitudinally therethrough three channels which are spaced apart horizontally as middle, left and right channels to define a first horizontal plane, and two upper channels spaced apart from each other and defining a second horizontal plane spaced from and above said first horizontal plane. The rear part extends rearwardly from said front part and comprises (a) a pair of left and right separators spaced apart horizontally to define a central space between them and left and right spaces outward of said left and right separators respectively, and (b) a divider extending horizontally between said separators and defining central upper and central lower spaces respectively. These separators are insertable between end portions of said multi-conductor cable such end portions of two twisted pairs may become situated in each of said left and right spaces respectively, and end portions of two other of said four twisted pairs may become situated in each of said central upper and lower spaces respectively. Each of said channels in said first horizontal plane is adapted to hold said end portions of one of said pairs wires substantially straight and parallel to each other as they extend through their respective channels, and each of said channels in said second horizontal plane adapted to hold a single wire of said twisted pair extending through said central upper space.

A wire aligner of this invention may have various configurations and still be applicable for use with cables of one or more twisted pairs of wires, since it provides uniformity and reliability to the untwisting of twisted pairs regardless of the number of twisted pairs that are exposed from a multi-conductor cable and attached to a load bar and thence to a plug housing.

Another embodiment of this invention is exemplified as a method of loading a load bar with the end portions of at least one and preferably four twisted pairs of wires of a multi-conductor cable for subsequent assembly with a modular plug housing. In the case of four twisted pairs, the new method comprises separating said four twisted pairs of wires of said multi-conductor cable from each other, untwisting each of said pairs substantially the same amount while extending the wires of each of said pairs forwardly and positioning said untwisted pairs of wires in said spaced apart channels respectively in said load bar.

In accordance with the present invention, these and other objects are achieved by providing a modular plug including a plug housing made of dielectric material including a plurality of parallel, spaced, longitudinally extending terminal-receiving slots at a forward end and a longitudinal cavity extending from a rear face thereof forward to a location below the slots such that the cavity is in communication with the slots. Each terminal-receiving slot receives a respective terminal blade or insulation displacing contact. The plug also includes a conductor management bar or load bar, arranged in the cavity and defining conductor-receiving channels.

BRIEF DESCRIPTION OF THE DRAWINGS

A more complete appreciation of the present invention and many of the attendant advantages thereof will be readily understood by reference to the following detailed description when considered in connection with the accompanying drawings in which.

DETAILED DESCRIPTION OF THE PREFERRED EMBODIMENTS

Figure 1:
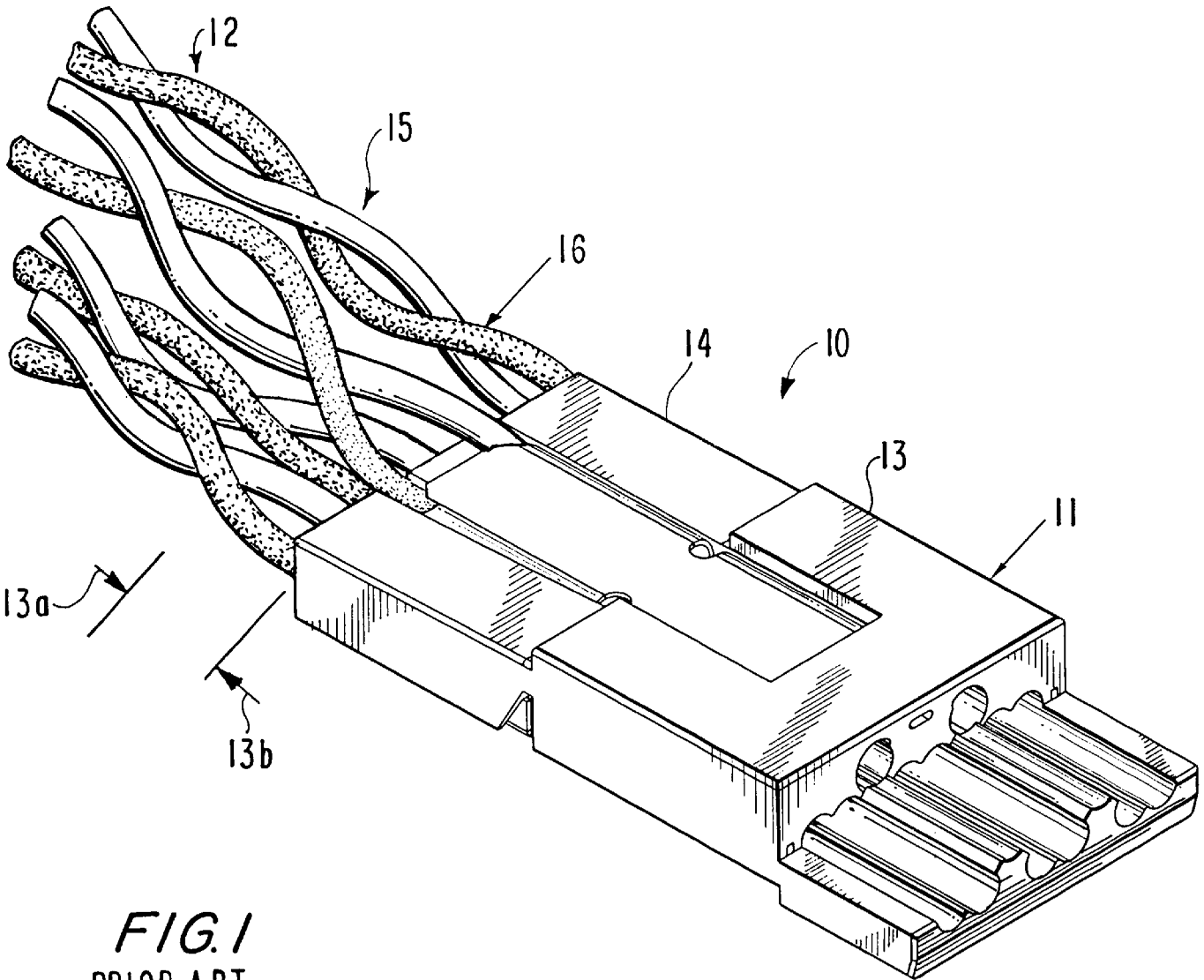
FIG. 1 PRIOR ART
FIG. 1 is a perspective view of a load bar according to the prior art.

Referring now to the drawings wherein like reference characters designate identical or corresponding parts throughout the several views, a wire aligner in accordance with the invention is used in conjunction with a multi-conductor cable which is combinable with a load bar which is combinable with a modular plug housing.

In the prior art, as shown in FIG. 1, management or load bar 10 formed of load bar housing 11 manages the orientation of wires 12 before their termination in the terminals of a standard modular plug-cable assembly (not shown). Wires 12 are standard UTP (unshielded twisted pair) and as such are subject to an uncontrolled amount of crosstalk due to inconsistency of the straightness or untwisting of the UTP wires at area situated between arrows 13*a*, 13*b*, which is caused when placing or dressing the wires into load bar housing 11. This problem is alleviated by the modular plug wire aligner, in accordance with the present invention, arranged adjacent to the load bar to control the straightness and untwisting of the wires, and thereby to control the amount of crosstalk between the wires.

Figure 2:
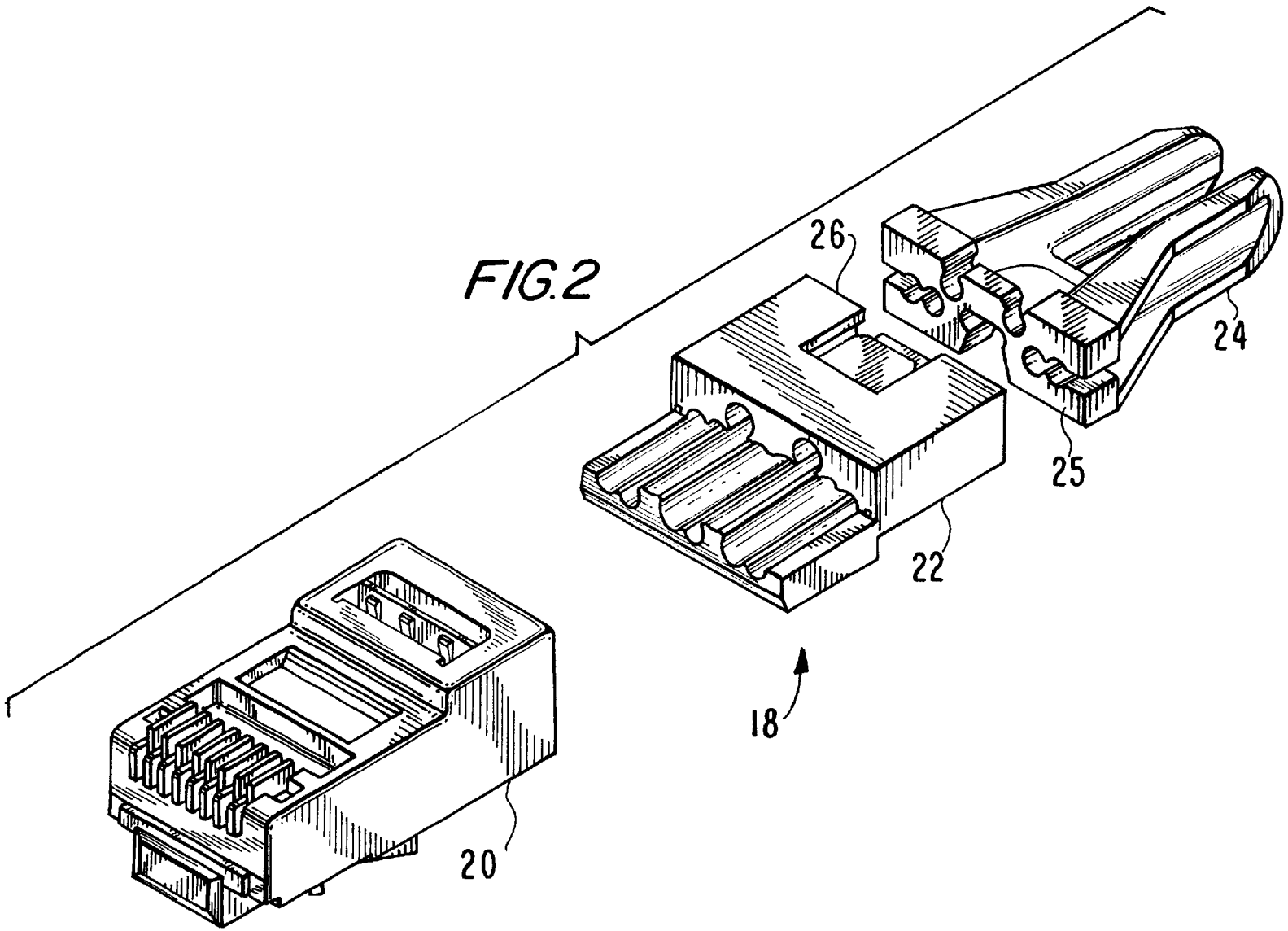
FIG. 2 is an exploded top perspective view of a plus assembly comprising a plug housing, a load bar and a wire aligner, with the cable omitted.
Figure 3:
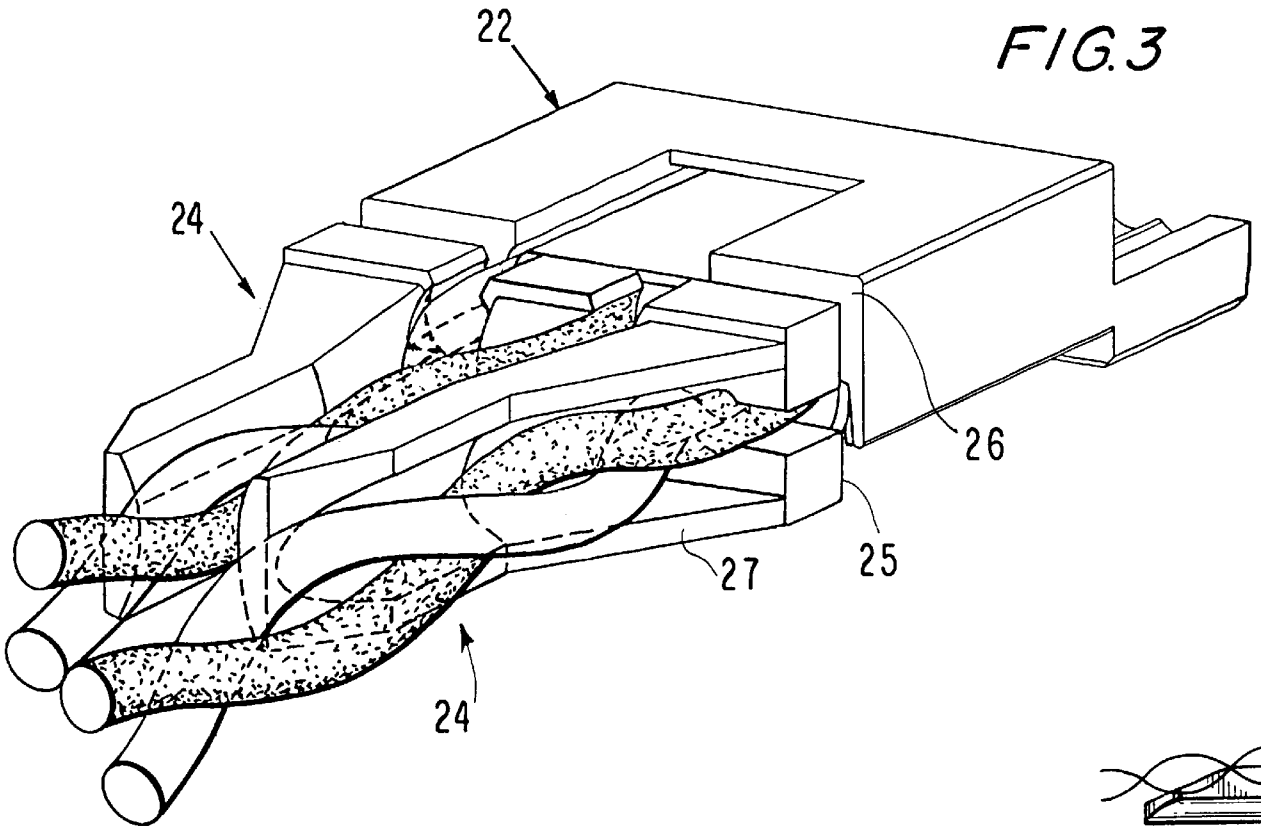
FIG. 3 is a perspective view of a modular plug wire aligner according to the present invention in use in conjunction with a load bar.

The present invention provides (a) a new modular plug assembly as seen in exploded view FIG. 2 comprising plug housing 20, load bar 22 and wire aligner 24, (b) a load bar and wire aligner subassembly as seen in FIG. 3, and (c) a wire aligner alone as seen in FIGS. 4–9.

As shown in FIGS. 2 and 3, modular plug wire aligner 24 is arranged adjacent and directly behind load bar 22. This load bar is a shortened version of a conventional load bar, such as a load bar of the type disclosed in FIG. 1 herein and in U.S. Provisional Patent Application No. 60/208,832 by Marowsky, et al., entitled Modular Electrical Plug, Plug-Cable Assemblies Including the Same, and Load Bar and Terminal Blade for Same, which is incorporated herein by reference to describe a load bar and plug with which a wire aligner according to the present invention may be used. The shortened length of load bar 22 allows both it and wire aligner 24 to be received within plug housing 20. The wire aligner's front face 25 interfaces with load bar's rear face 26.

As more clearly seen in FIGS. 4–9, the wire aligner includes wire aligner housing 27 having front, middle and end portions 27F, 27M, 27E respectively, right and left sides 27R, 27L, top and bottom faces 27T, 27B and front face 25. The front portion 27F defines therein conductor-receiving channels for eight conductors untwisted from four twisted pairs of conductors. These channels are distributed as left and right channels 30L, 30R and middle lower channels 32L, 32R along a first horizontal plane $P_1$ and middle upper channels 38L, 38R along a second horizontal plane $P_2$ above the middle lower channels.

The left and right channels are alternately called "load latches" and the middle lower channels are alternately called "scope down channels"; however, for clarity and consistency, these channels will be designated herein by their simple descriptive names, left, right, middle lower and middle upper channels. Said middle upper channels 38L, 38R are spaced apart a distance generally greater than the combined width of channels 32L, 32R.

Figure 6:
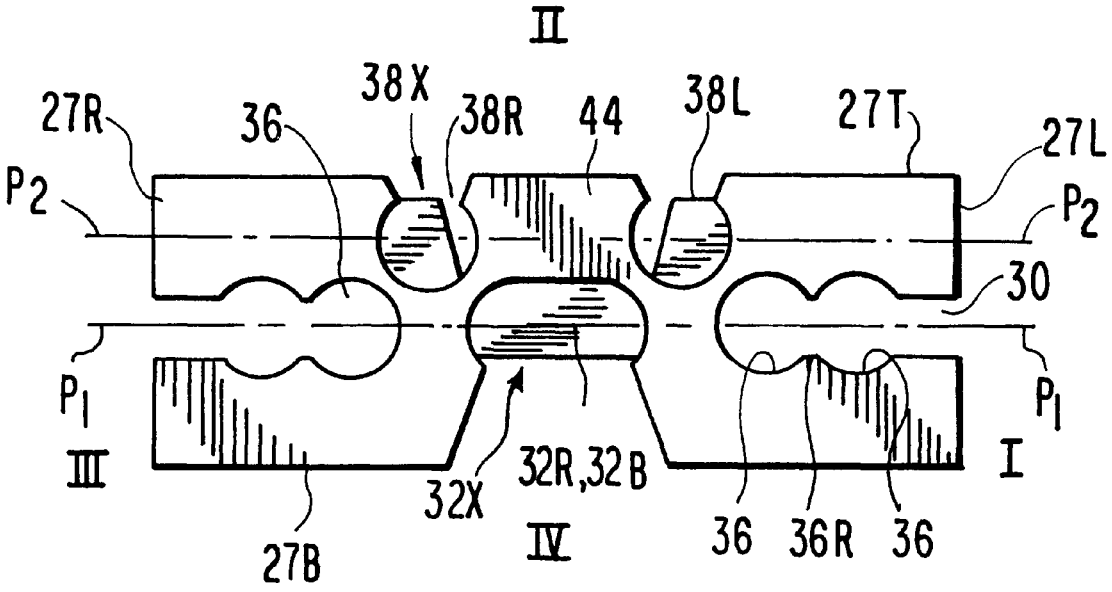
FIG. 6 is a front elevation view thereof.

Each of said right and left channels 30R, 30L comprises a pair of adjacent and generally circular sub-channels 36 which are arranged to receive two conductors of one unshielded twisted pair. Further, as seen in FIG. 6, each pair of sub-channels 36 is partially divided by a rib 36R and each receives and locks into place a single conductor from a respective wire pair. Each of these right and left channels 30R, 30L opens laterally to the right and left side at 31R, 31L respectively. Between said left and right channels 30L, 30R is the middle lower channel 32L, 32R of generally oval cross-section with a downward opening 32X for receiving and securing the untwisted ends of one twisted pair of wires.

As noted above, the front portion 27F of this wire aligner has the middle upper conductor-receiving channels 38L, 38R, each being generally octagonal or substantially circular, with an upward opening 38X. These channels are widely spaced apart by wall 38W, with channel 38L, for example, being situated above and laterally between left channel 30L and middle lower channel 32L, and with channel 38R being situated above and laterally between right channel 30R and middle lower channel 32R. Channel 38R is thus separated from channel 32R by longitudinal wall segment 39R, and channel 38L is separated from channel 32 by longitudinal wall segment 39L.

Figure 4:
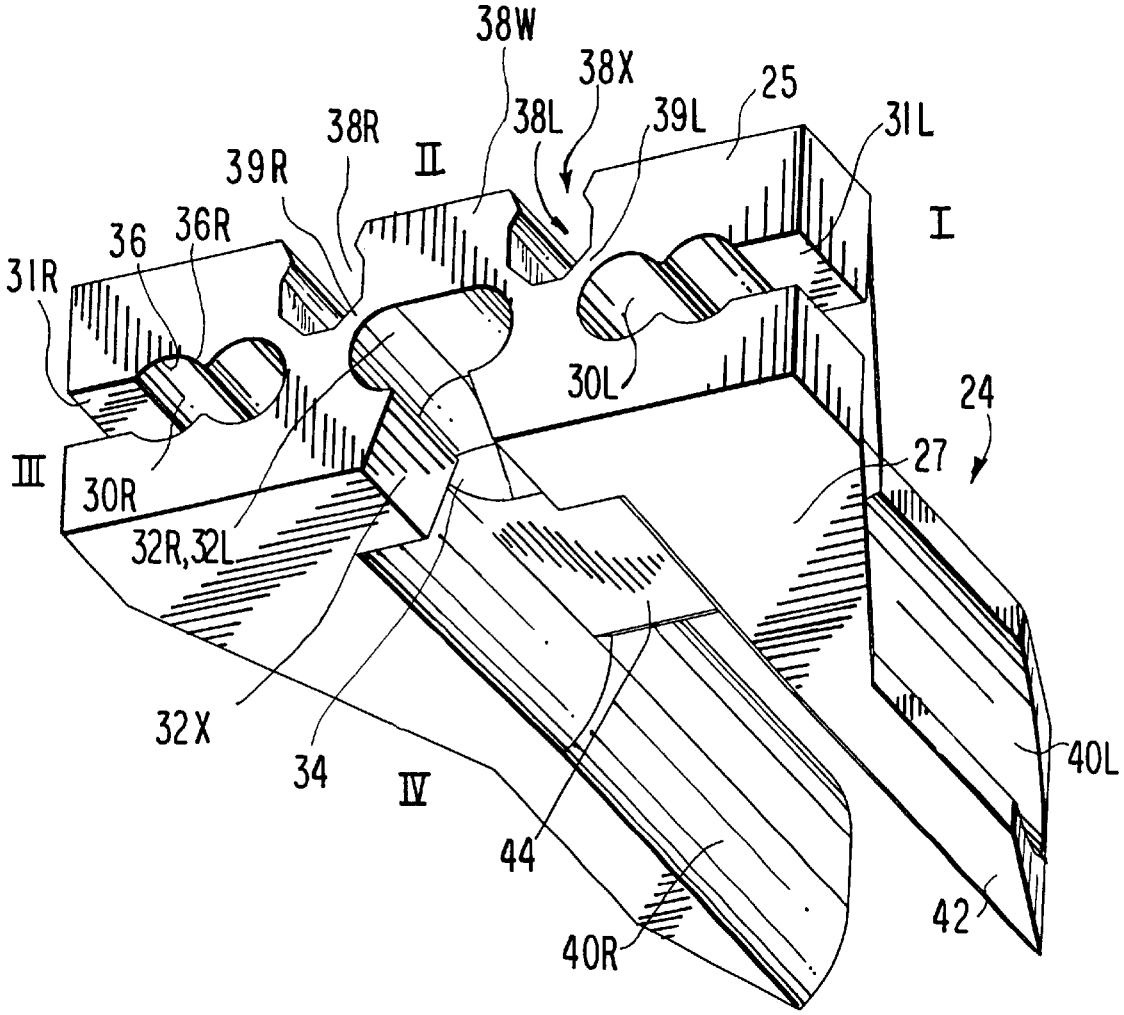
FIG. 4 is a bottom front perspective view of a modular plug wire aligner according to the present invention.
Figure 5:
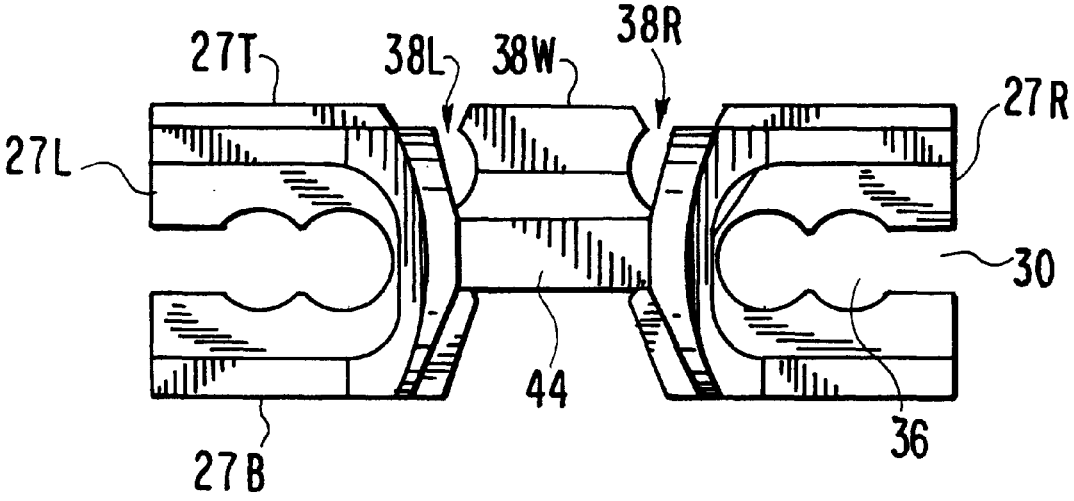
FIG. 5 is a rear elevation view thereof.
Figure 7:
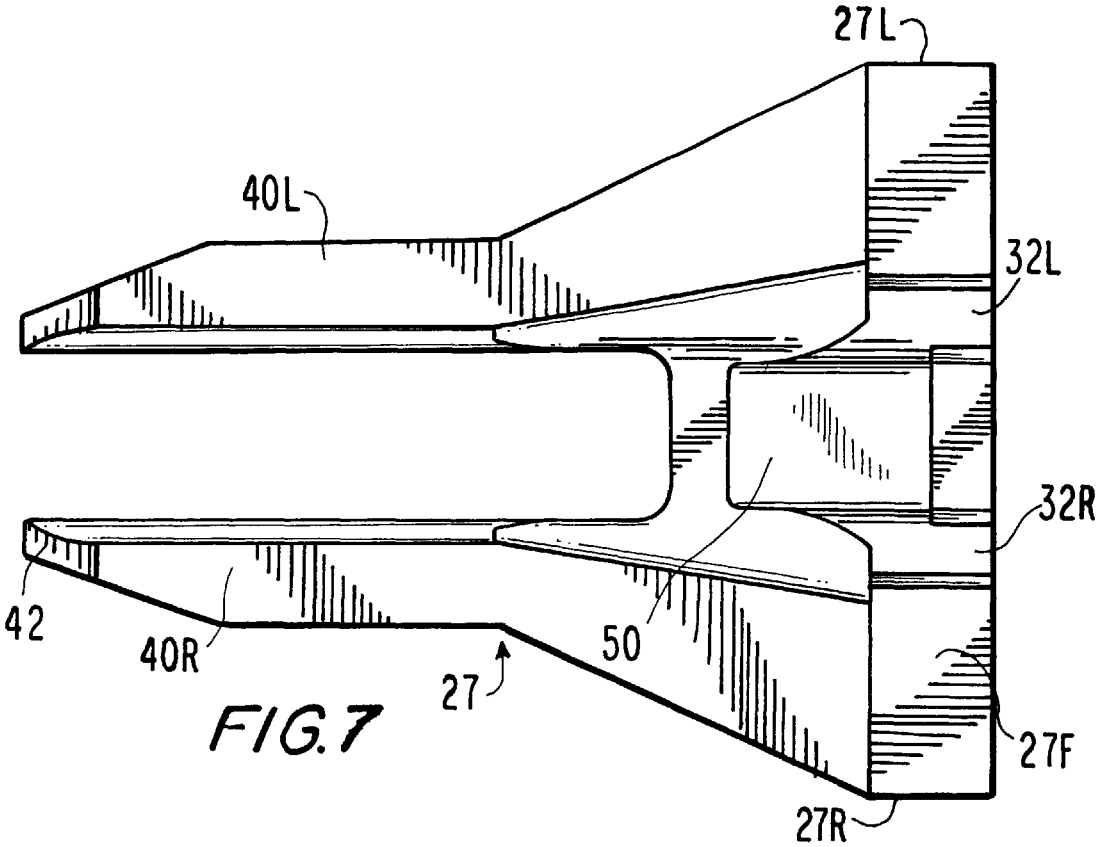
FIG. 7 is a top plan view thereof.
Figure 9:
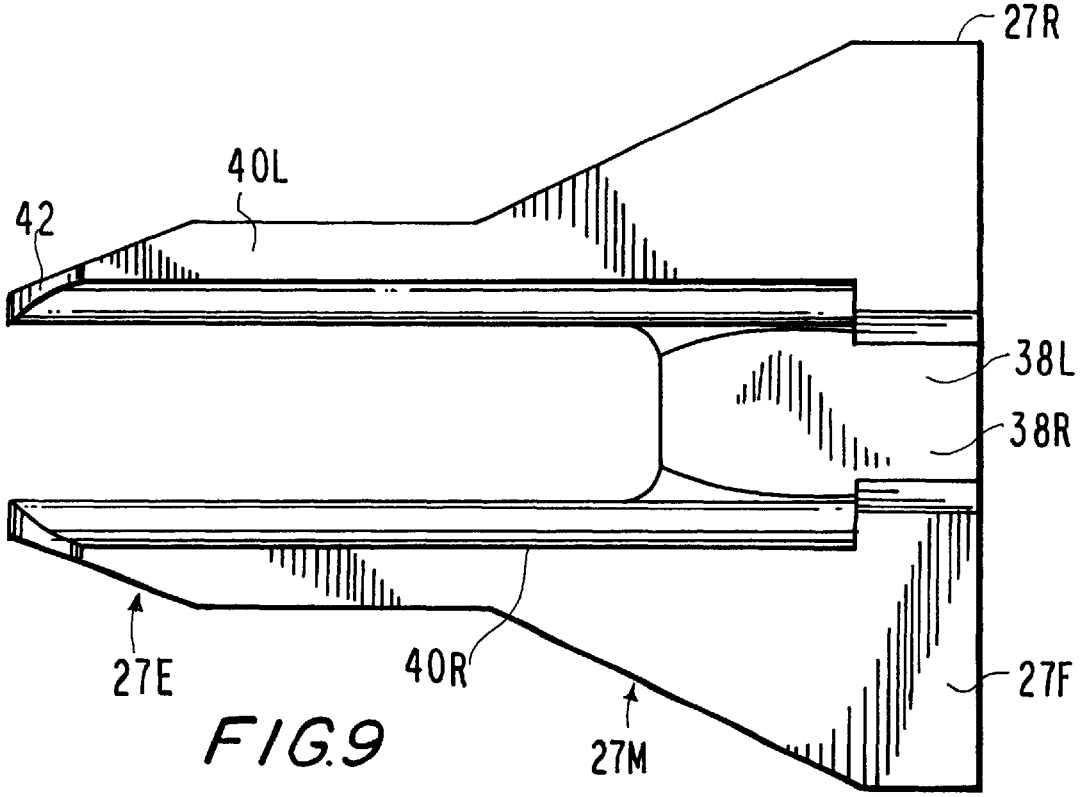
FIG. 9 is a bottom plan view thereof.
Figure 8:
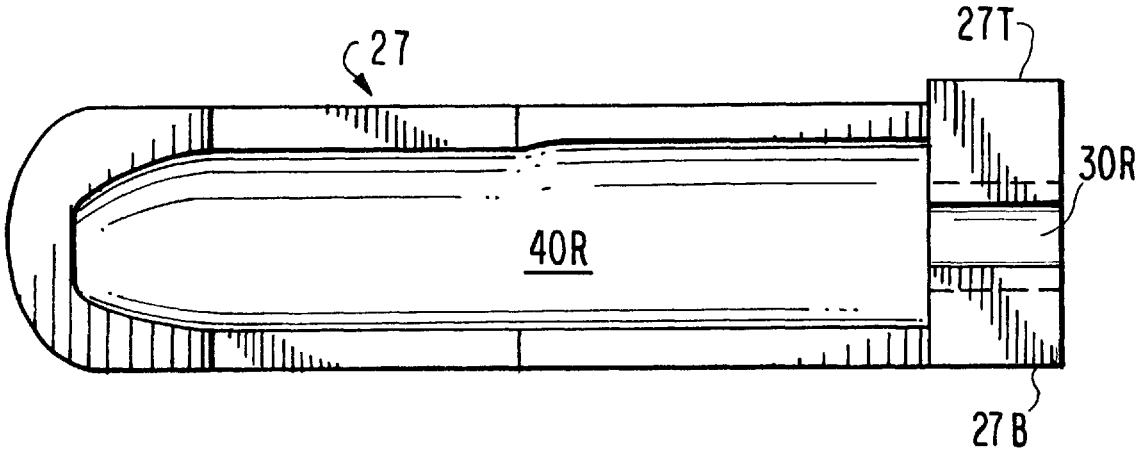
FIG. 8 is a side elevational view thereof.

As seen in FIGS. 4, 7 and 9, the rear portion of the new wire aligner has a pair of spaced apart separators, formed as blades 40R, 40L, each tapered to a relatively narrow edge 42. Separator 40L, for example, is located laterally between left channel 30L and the middle lower channel 32L. Separator 40R is the mirror image of separator 40L. Separator 40R provides a barrier to maintain separation of a first twisted wire pair directed to left channel 30L and a second twisted wire pair directed to middle lower channel 32L. Horizontal wall segment 44 is a planar insert or a panel contiguous with housing 27 which maintains separation of a third twisted wire pair directed to channels 32L, 32R and a fourth twisted wire pair in middle upper channels 38L, 38R.

Figure 11:
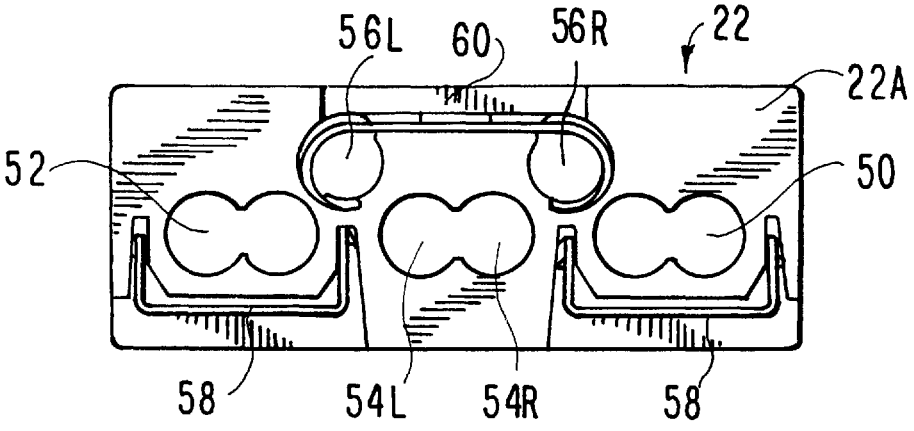
FIG. 11 is a rear elevation view of the load bar of FIG. 10.
Figure 10:
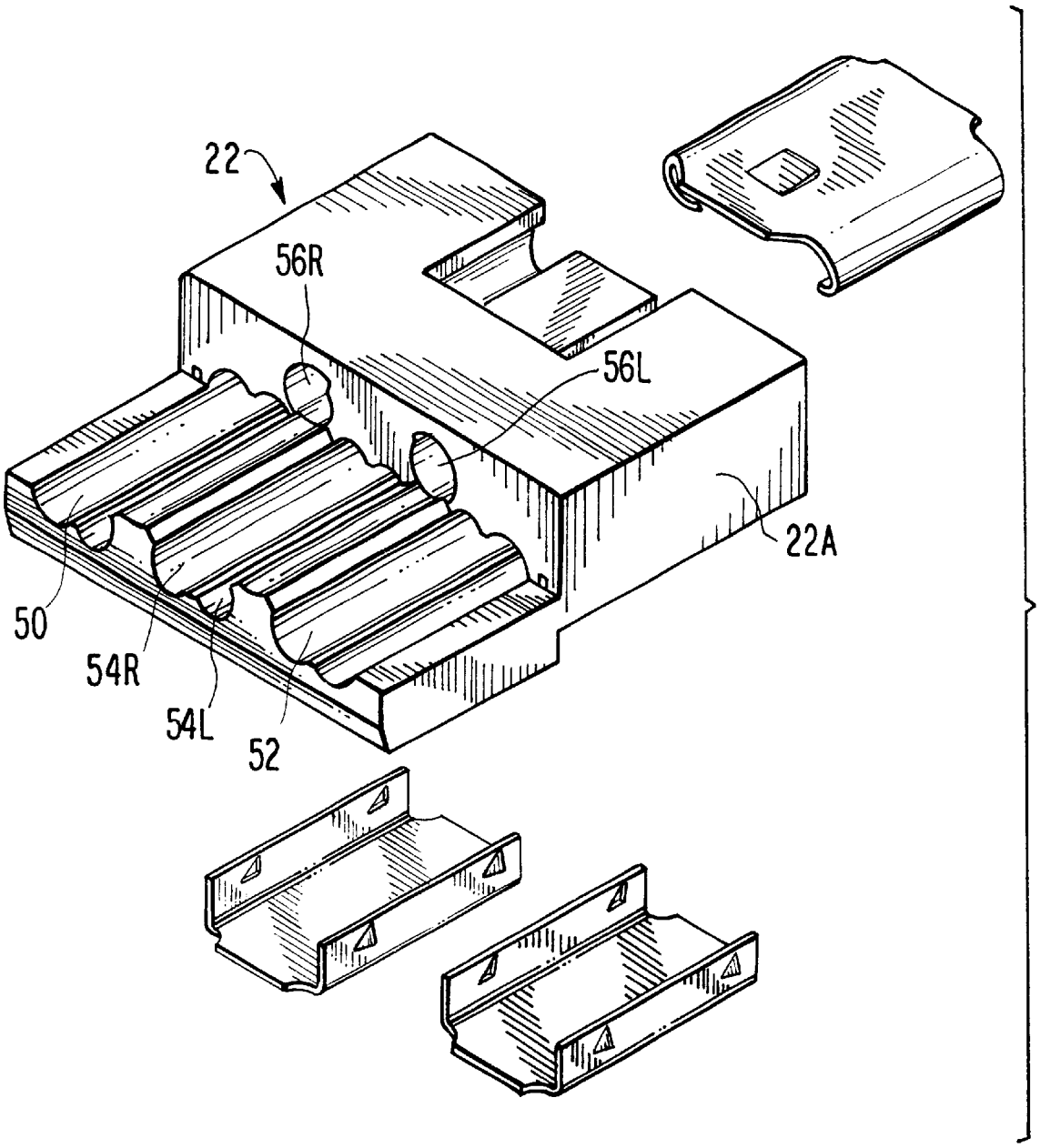
FIG. 10 is an exploded perspective view of a load bar according to the present invention.

The load bar 22 seen in FIG. 2 is illustrated in greater detail in FIGS. 10 and 11 which show load bar housing 22A having left and right dual channels 50, 52, middle lower channels 54L, 54R, and middle upper channels 56L, 56R. These load bar channels correspond to matching channels in the wire aligner and receive the end portions of the untwisted pairs of conductors. Below channels 50 and 52 are conductive strips 58 and above channels 56L, 56R is conductive strip 60 to partially enclose the conductor wires lying in those channels. These conductive strips are more fully described in U.S. patent application Ser. No. 09/578,397 incorporated herein by reference.

A method of assembling a plug-cable assembly including a wire aligner according to the present invention includes first slitting the cable jacket of a UTP cable. The rear portion of wire aligner 24 is then inserted within the cable jacket such that the separators 40L, 40R extend taper-end first within the cable jacket and between twisted pairs. These twisted pairs are guided by the wire aligner into a distribution pattern such that one pair is directed laterally through openings 31L, 31R into each of channels 30R, 30L, one pair is directed laterally through openings 38X into each of channels 38L, 38R, and one pair is directed laterally through opening 32X into each of channels 32L, 32R. In this manner the wire pairs are arranged such that a single wire pair is located within each of Quadrants I–IV. (See FIGS. 4 and 6.) Individual wires of the wire pairs in each respective quadrant are dressed or extended through corresponding channels in load bar 20. The load bar is slid along the wires such that it is tightly adjacent to front face 25 of the wire aligner and may be partially covered by the cable jacket. The wires are then extended into a plug housing along with the exposed portion of load bar 22 until the load bar is fitted within the plug housing in a conventional manner. The wires are then terminated to terminals within the plug housing in a conventional manner and any excess wire is removed. Termination of the wires further retains load bar 22 and wire aligner 24 together.

Figure 3A:
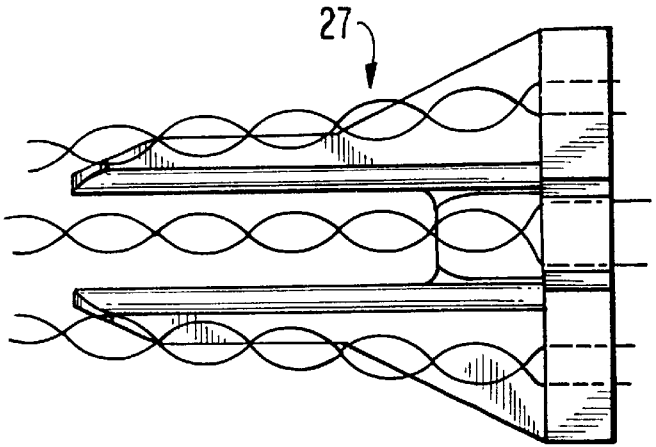
FIG. 3A is a schematic top plan view of the wire aligner in FIG. 3.

FIG. 3A shows schematically and not to scale how this embodiment of the wire aligner of this invention separates multiple twisted pairs but maintains substantially uniform twist in these pairs until they are untwisted generally similarly at the front portion of the wire aligner.

A conventional strain relief element (not shown) may be included in the plug housing. Upon termination of the wires the strain relief element is compressed against the cable jacket where the jacket overlies wire aligner 24 and load bar 22. This serves to relieve the stress on the ends of the wires terminated at the terminals and to more reliably retain the load bar and the wire aligner together with each other and with the cable jacket.

As illustrated herein, wire aligner 24 retains twisted wire pairs in an organized and twisted form so that they enter load bar in this form, without random deviation between the cable and load bar. The individual wires of each wire pair remain twisted until they individually extend through each lock which locks an individual wire in place. By retaining twisted wire pairs in an organized, uniformly twisted and unstraightened form throughout the length of the wire between the cable and load bar 22, wire aligner 24 minimizes crosstalk which is generated by the straightening and intermingling of twisted wire pairs. Thus, each of the four pairs of twisted wires begins to be untwisted at about the same longitudinal position on the wire aligner as it enters the front portion thereof, and then is essentially fully untwisted and straightened while traversing said front portion, and remains in said untwisted and straightened state while extending through the load bar.

The new wire aligner improves the reliability of the modular plug by providing a repeatable means of organizing the wire conductors' transition from the cable to the load or management bar. There will be a consistent amount of twists along the length of the twisted pair as it approaches the load bar and a consistent amount and configuration of untwist of each twisted pair of wires extending into the array of channels at the front of the wire aligner and into the load bar.

Obviously, numerous modifications and variations of the present invention are possible in light of the above teachings.

What is claimed is:

1. A wire aligner for assembly with the end portions of four twisted pairs of wires of a multi-conductor cable, comprising:

a wire aligner housing having front and rear parts along a central longitudinal axis, said front part defining longitudinally therethrough three channels which are spaced apart horizontally as middle, left and right channels to define a first horizontal plane, and two upper channels spaced apart from each other and defining a second horizontal plane spaced from and above said first horizontal plane, said rear part extending rearwardly from said front part and comprising (a) a pair of left and right separators spaced apart horizontally to define a central space between them and left and right spaces outward of said left and right separators respectively, and (b) a divider extending horizontally between said separators and defining central upper and central lower spaces respectively, said separators being insertable between end portions of said multi-conductor cable such that end portions of two twisted pairs may become situated in each of said left and right spaces respectively, and end portions of two other of said four twisted pairs may become situated in each of said central upper and lower spaces respectively, each of said channels in said first horizontal plane adapted to hold said end portions of one of said pairs wires substantially straight and parallel to each other as they extend through their respective channels, and each of said channels in said second horizontal plane adapted to hold a single wire of said twisted pair extending through said central upper space, and wherein said separators have a length dimension and said divider extends rearwardly from said front part and extends a distance less than said length of said separators.

2. A wire aligner according to claim 1 wherein each of said upper channels is situated horizontally between said middle channel and one of said left and right channels.

3. A wire aligner according to claim 1 wherein said divider is a panel that extends generally rearwardly and horizontally from said front part.

4. A wire aligner according to claim 1 wherein each of said upper channels has a generally octagonal cross-section.

5. A wire aligner according to claim 1 wherein said middle channel has a generally oval cross-section.

6. A wire aligner according to claim 1 wherein each of said separators comprises a lead part that inclines rearwardly and inwardly from said front part, and an insertion part that extend rearwardly as a blade, said blades being spaced apart and generally parallel.

7. A wire aligner according to claim 6 wherein each of said insertion parts tapers in said rearward direction to a thin edge.

8. In combination, a wire aligner according to claim 1 and a multi-conductor having four twisted wire pairs having their end portions separated by said separators and divider, said end portions being extended through said left, right, central upper and central lower spaces respectively.

9. A combination according to claim 8 wherein said end portions of said twisted pairs are each untwisted substantially the same amount, as they are separated by said separators and said divider and extended into said left, right, central upper and central lower spaces respectively.

10. The combination according to claim 9 wherein said four twisted pairs have the standard twisted pair designation numbers 1, 2, 3, and 4, and are situated in said left, right, central and upper spaces respectively.

11. A wire aligner and load bar assembly comprising a wire aligner according to claim 1 and a load bar coupled to said front part of said wire aligner, said load bar having wire-receiving channels arranged to correspond spatially with said channels of said wire aligner's front part and to receive said end portions of said untwisted pairs of wires extending axially forward and out of said channels of said wire aligner's front part.

12. A wire aligner and load bar assembly according to claim 11 further comprising a modular plug housing into which said wire aligner and load bar assembly is inserted, said modular plug housing comprising a plug housing having a recess opening rearward for receiving said wire aligner and load bar assembly.

13. A wire aligner and load bar assembly according to claim 12, wherein said modular plug housing further comprises contact terminals connectible to said end portions of said twisted pairs of wire extending into said load bar.

14. A wire aligner according to claim 1 wherein each of said left and right channels define a bore surface and further comprises a longitudinally rib extending generally radially inward on said bore surface to maintain separate said two end portions which extend therethrough.

15. A wire aligner according to claim 14 wherein said front part of said wire aligner housing has top, bottom, and side outer surfaces, and each of said left and right channels opens outwardly to said left and right outer surfaces respectively, and said middle channel opens downwardly to said bottom outer surface, and said upper channels open upwardly to said top outer surface.

16. A wire aligner according to claim 14 wherein each of said separators is tapered in said rearward direction to a thin terminal edge.

17. A wire aligner according to claim 15 wherein for each of said channels said outward opening has a transverse dimension that is less than the outer diameter of said end portions of said twisted pairs of wires placeable therein, thereby precluding said end portions from moving transversely out their respective channels.

18. A wire aligner for assembly with the end portions of four twisted pairs of wires of a multi-conductor cable comprising:

a wire aligner housing having front and rear parts along a central longitudinal axis, said front part defining longitudinally therethrough three channels which are spaced apart horizontally as middle, left and right channels to define a first horizontal plane, and two upper channels spaced apart from each other and defining a second horizontal plane spaced from and above said first horizontal plane, said rear part extending rearwardly from said front part and comprising (a) a pair of left and right separators spaced apart horizontally to define a central space between them and left and right spaces outward of said left and right separators respectively, and (b) a divider extending horizontally between said separators and defining central upper and central lower spaces respectively, said separators being insertable between end portions of said multi-conductor cable such that end portions of two twisted pairs may become situated in each of said left and right spaces respectively, and end portions of two other of said four twisted pairs may become situated in each of said central upper and lower spaces respectively, each of said channels in said first horizontal plane adapted to hold said end portions of one of said pairs wires substantially straight and parallel to each other as they extend through their respective channels, and each of said channels in said second horizontal plane adapted to hold a single wire of said twisted pair extending through said central upper space, wherein each of said left and right channels defines a bore surface and further comprises a longitudinally rib extending generally radially inward on said bore surface to maintain separate said two end portions which extend therethrough, wherein said front part of said wire aligner housing has top, bottom, and side outer surfaces, and each of said left and right channels opens outwardly to said left and right outer surfaces respectively, and said middle channel opens downwardly to said bottom outer surface, and said upper channels open upwardly to said top outer surface, and wherein for each of said channels said outward opening has a transverse dimension that is less than the outer diameter of said end portions of said twisted pairs of wires placeable therein, thereby precluding said end portions from moving transversely out their respective channels.

* * * * *